US006085656A

United States Patent [19]

Lewis

[11] Patent Number: 6,085,656

[45] Date of Patent: Jul. 11, 2000

[54] METHOD OF LITHOGRAPHIC IMAGING WITH REDUCED DEBRIS-GENERATED PERFORMANCE DEGRADATION AND RELATED CONSTRUCTIONS

[75] Inventor: Thomas E. Lewis, East Hampstead, N.H.

[73] Assignee: Presstak, Inc., Hudson, N.H.

[21] Appl. No.: 09/122,323

[22] Filed: Jul. 24, 1998

[51] Int. Cl.[7] ..... B41N 1/14

[52] U.S. Cl. ..... 101/460; 101/462; 101/467

[58] Field of Search ..... 101/453, 454, 101/457, 462, 463.1, 465, 466, 467, 425, 460; 430/302, 303

[56] References Cited

U.S. PATENT DOCUMENTS

| | | | |
|---|---|---|---|
| 5,148,746 | 9/1992 | Fuller et al. | 101/425 |
| 5,378,580 | 1/1995 | Leenders | 101/467 |
| 5,493,971 | 2/1996 | Lewis et al. | 101/467 |
| 5,783,364 | 7/1998 | Ellis et al. | 101/454 |
| 5,786,129 | 7/1998 | Ellis | 101/454 |
| 5,807,658 | 9/1998 | Ellis et al. | 101/467 |

FOREIGN PATENT DOCUMENTS

| | | |
|---|---|---|
| 1050805 | 3/1979 | Canada . |
| 0644047A3 | 3/1995 | European Pat. Off. . |
| 0664211A2 | 7/1995 | European Pat. Off. . |
| 0844080A2 | 5/1998 | European Pat. Off. . |
| WO 97/00735 | 1/1997 | WIPO . |
| WO 97/00777 | 1/1997 | WIPO . |
| WO98/50231 | 12/1998 | WIPO . |

*Primary Examiner*—Stephen R. Funk
*Attorney, Agent, or Firm*—Cesari and McKenna, LLP

[57] ABSTRACT

The ability to clean ablation-type lithographic printing plates is enhanced by the formation of debris chemically compatible with a desired cleaning fluid. The debris may originate in the ablation layer of the printing member, or in a separate insulating layer disposed above the ablation layer.

19 Claims, 1 Drawing Sheet

METHOD OF LITHOGRAPHIC IMAGING WITH REDUCED DEBRIS-GENERATED PERFORMANCE DEGRADATION AND RELATED CONSTRUCTIONS

BACKGROUND OF THE INVENTION

1. Field of the Invention

The present invention relates to digital printing apparatus and methods, and more particularly to imaging of lithographic printing-plate constructions on- or off-press using digitally controlled laser output.

2. Description of the Related Art

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-abhesive fountain solution prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers. For example, U.S. Pat. Nos. 5,351,617 and 5,385,092 (the entire disclosures of which are hereby incorporated by reference) describe an ablative recording system that uses low-power laser discharges to remove, in an imagewise pattern, one or more layers of a lithographic printing blank, thereby creating a ready-to-ink printing member without the need for photographic development. In accordance with those systems, laser output is guided from the diode to the printing surface and focused onto that surface (or, desirably, onto the layer most susceptible to laser ablation, which will generally lie beneath the surface layer).

U.S. Pat. No. 5,339,737, Re. 35,512, 5,783,364, and 5,807,658, the entire disclosures of which are hereby incorporated by reference, describe a variety of lithographic plate configurations for use with such imaging apparatus. In general, the plate constructions may include a first, topmost layer chosen for its affinity for (or repulsion of) ink or an ink-abhesive fluid. Underlying the first layer is an image layer, which ablates in response to imaging (e.g., infrared, or "IR") radiation. A strong, durable substrate underlies the image layer, and is characterized by an affinity for (or repulsion of) ink or an ink-abhesive fluid opposite to that of the first layer. Ablation of the absorbing second layer by an imaging pulse generally weakens the topmost layer as well.

By disrupting its anchorage to an underlying layer, the topmost layer is rendered easily removable in a post-imaging cleaning step. This creates an image spot having an affinity for ink or an ink-abhesive fluid differing from that of the unexposed first layer, the pattern of such spots forming a lithographic plate image.

An accepted approach to cleaning involves subjecting the imaged plate to mechanical action, e.g., rubbing or wiping with a cloth, or the rotation of a brush (see U.S. Pat. No. 5,148,746). Mechanical action can occur under dry conditions or be accompanied by a cleaning fluid. In the latter case, the fluid assists in the cleaning process, reducing the amount and intensity of mechanical friction necessary to remove debris and, as a result, lessening the chance of damage to the intact top layer. The cleaning fluid is generally a non-solvent for that layer, once again in order to avoid damage to unimaged areas. In particular, dry plates utilize silicone top layers, which are permeable to various solvents and tend to "swell" under their influence, resulting in weakened anchorage to underlying layers and, consequently, reduced plate durability and performance. Unfortunately, the need to preserve the silicone layer can limit the overall degree of cleaning effectiveness. Without complete removal of imaging byproducts and other pyrolitic debris from imaged portions of the plate, the necessary affinity difference between ink-repellent and ink-accepting layers cannot be achieved.

DESCRIPTION OF THE INVENTION

Brief Summary of the Invention

The present invention enhances the ability to clean printing members following ablation imaging by creating debris compatible with a cleaning fluid. This cleaning fluid is selected so as not to dissolve—i.e., to act as a "non-solvent" for—the topmost layer of the printing member. For example, in a dry plate having a silicone top layer, the cleaning fluid may be aqueous in nature. If applied to prior-art dry-plate constructions, aqueous cleaning fluids would have limited ability to remove silicone fragments (and de-anchored portions of the silicone top layer overlying imaged areas) due to chemical incompatibility therewith. The present invention may be applied to silicone dry plates to generate hydrophilic debris, thereby facilitating cleaning with aqueous fluids not expressly formulated for silicone compatibility. As used herein, the term "debris" is intended to connote thermally generated breakdown products, which may arise from chemical mechanisms such as homolysis or mechanical processes such as shear or tearing, and which may range in size from the molecular level to bulk (although microscopic) fragments.

In one aspect, an intervening layer, disposed between the imaging layer (which includes a polymeric matrix) and the surface layer of the printing member, assists with removal of an overlying layer following imaging. The intervening layer may also provide an insulating function, discouraging thermal degradation of the surface layer. The intervening layer desirably incorporates functional groups that are compatible with a desired cleaning fluid, and which thereby assist the post-imaging cleaning process. For example, the insulating layer may be an acrylate layer with hydrophilic functional groups, which render exposed portions of the insulating layer interactive with an aqueous cleaning fluid. Alternatively, the insulating layer may be hydrophilic; for example, cross-linked hydroxyethylcellulose or, more preferably, polyvinyl alcohol chemical species adhere well to metal and silicone layers.

In a second aspect, the characteristics of the imaging (ablation) layer rather than an insulating layer are modified to enhance removal, following imaging, of the overlying layer. For example, an organic imaging layer may be loaded with a hydrophilic pigment that chemically survives ablation (in addition to or in lieu of a conventional IR-absorptive pigment, such as carbon black), and whose incorporation into the overlying layer as a result of imaging eases subsequent aqueous removal of that layer. At the same time, introduction of a hydrophilic material into the ink-receptive layer will not affect performance so long as the material is not oleophobic.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
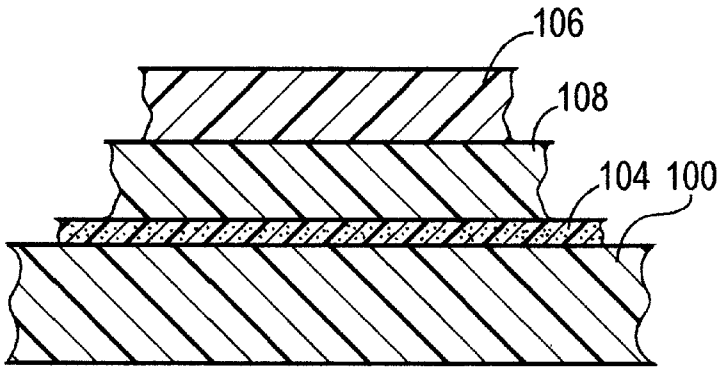
FIG. 1 is an enlarged sectional view of a lithographic plate having a silicone topmost layer, an insulating layer, a polymeric imaging layer, and a substrate.

Imaging apparatus suitable for use in conjunction with the present printing members includes at least one laser device that emits in the region of maximum plate responsiveness, i.e., whose $lambda_{max}$ closely approximates the wavelength region where the plate absorbs most strongly. Specifications for lasers that emit in the near-IR region are fully described in the '737 and '512 patents (the entire disclosure of which is hereby incorporated by reference); lasers emitting in other regions of the electromagnetic spectrum are well-known to those skilled in the art.

Suitable imaging configurations are also set forth in detail in the '737 and '512 patents. Briefly, laser output can be provided directly to the plate surface via lenses or other beam-guiding components, or transmitted to the surface of a blank printing plate from a remotely sited laser using a fiberoptic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid plate movement (e.g., through use of high-speed motors) and thereby utilize high laser pulse rates, can frequently utilize a single laser as an imaging source.

A representative printing member in accordance with the present invention is illustrated in FIG. 1. As used herein, the term "plate" or "member" refers to any type of printing member or surface capable of recording an image defined by regions exhibiting differential affinities for ink and/or fountain solution; suitable configurations include the traditional planar lithographic plates that are mounted on the plate cylinder of a printing press, but can also include cylinders (e.g., the roll surface of a plate cylinder), an endless belt, or other arrangement.

With reference to FIG. 1, a representative printing member includes a substrate 100, a radiation-absorptive imaging layer 104, a surface layer 106, and, disposed between layers 104 and 106, an insulating layer 108. In this case, the layers 100, 104, 108 resemble the wet-plate construction illustrated in FIG. 1 of the '737 patent. In the present context, however, the printing member is intended for dry printing, and surface layer 106 is therefore oleophobic.

Surface layer 106 may be a silicone polymer to which ink will not adhere, while layer 100 is oleophilic and accepts ink. Layer 104 is generally polymeric, i.e., based on a polymeric matrix. This layer ablates in response to imaging radiation.

The characteristics of substrate 100 depend on application. If rigidity and dimensional stability are important, substrate 100 can be a metal, e.g., a 5-mil aluminum sheet. Depending on the transmissivity of layer 104 to imaging radiation, the aluminum may be polished so as to reflect back into imaging layer 104 any radiation penetrating the overlying layers. Alternatively, layer 100 can be a polymer, as illustrated, such as a polyester film; once again, the thickness of the film is determined largely by the application. The benefits of reflectivity can be retained in connection with a polymeric substrate 100 by using a material containing a pigment that reflects imaging (e.g., IR) radiation. A material suitable for use as an IR-reflective substrate 100 is the white 329 film supplied by ICI Films, Wilmington, Del., which utilizes IR-reflective barium sulfate as the white pigment. A preferred thickness is 0.007 inch. Finally, a polymeric substrate 100 can, if desired, be laminated to a metal support (not shown), in which case a thickness of 0.002 inch is preferred. As disclosed in U.S. Pat. No. 5,570,636, the entire disclosure of which is hereby incorporated by reference, the metal support or the laminating adhesive can reflect imaging radiation.

Useful materials for layer 106 and techniques of coating are disclosed in the '737 and '512 patents. Basically, suitable silicone materials are applied using a wire-wound rod, then dried and heat-cured to produce a uniform coating deposited at, for example, 2 g/m In dry-plate embodiments, layers 106 and 100 exhibit different affinities for ink.

Layer 108 contains functional groups that assist with removability following imaging; that is, application of an imaging pulse will ablate layer 104 within the imaged region, but will likely cause only minor damage to layer 108 and, as a result, to layer 106. These layers are rendered removable, however, by virtue of their deanchorage from substrate 100. That removal may be accomplished by mechanical action in the presence of a cleaning fluid, and chemical compatibility between that fluid and functional groups of the layer 108 polymer assists with its removal in imaged areas; so long as the materials are chosen so as to exhibit adequate interlayer adhesion, this compatibility will not cause damage to the unimaged areas during cleaning.

If the cleaning fluid is aqueous in nature, layer 108 is hydrophilic (or at least more hydrophilic than surface layer 106). In one approach, layer 108 is a polyvinyl alcohol. These materials exhibit superior adhesion both to a silicone layer 106 and to a titanium-based layer 104. Moreover, polyvinyl alcohol layers cast from water are not affected by most press solvents, resulting in excellent plate durability during use. Suitable polyvinyl alcohol materials include the AIRVOL polymer products (e.g., AIRVOL 125 or AIRVOL 165, highly hydrolized polyvinyl alcohols supplied by Air Products, Allentown, Pa.). The polyvinyl alcohol may be coated onto substrate 100 by combining it with a large excess of water (e.g., at a 98:2 ratio, w/w) and applying the mixture with a wire-wound rod, following which the coating is dried for 1 min at 300° F. in a lab convection oven. An application weight of 0.2–0.5 g/m$^2$ is typical.

In another approach, layer 108 is an acrylate material incorporating hydrophilic functional groups that render it compatible with (and removable by) an aqueous cleaning fluid. Hydrophilic groups that may be bound to or within acrylate monomers or oligomers include pendant phosphoric acid and ethylene oxide substitution. Preferred materials include the β-carboxyethyl acrylate; the polyethylene glycol diacrylates discussed above; the EB-170 product, a phosphoric acid- functional acrylate supplied by UCB Radcure, Inc., Atlanta, Ga.; and the PHOTOMER 4152 (pendant hydroxy), 4155 and 4158 (high ethoxy content), and 6173 (pendant carboxy) products supplied by Henkel.

Alternatively, hydrophilic compounds may be included as non-reactive components in the coating mixture, which become entrained within the resulting cured matrix and present hydrophilic sites that confer water wettability to the coating. Such compounds include polyethylene glycols and trimethylol propane. Particularly when applied by coating (as opposed to vacuum deposition), the range of non-acrylate, hydrophilic organic materials that can be added to an acrylate mixture is substantial, since molecular weight is not a significant consideration. Essentially, all that is required is solubility or miscibility in the acrylate base coating. Acrylic copolymers (including polyacrylic acid polymers) having high acrylic acid content are also possible. Non-vacuum applications also facilitate use of solid filler materials, particularly inorganics (such as silicas) to promote interactions with water-based cleaning solutions. Such fillers can be hydrophilic and/or can introduce porosity (texture), such as that obtained with conductive carbon blacks (e.g., the Vulcan XC-72 pigment supplied by the Special Blacks Division of Cabot Corp., Waltham, Mass.).

T-resins and ladder polymers represent still another class of material that can serve as layer 108. These materials can be coated from a solvent and exhibit high heat resistance. T-resins are highly crosslinked materials with the empirical formula $RSiO_{1.5}$. Ladder polymers may exhibit the structure

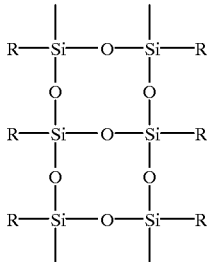

Both of these types of materials can be rendered hydrophilic through selection of an appropriate R group—e.g., silanol, aminopropyl, glycidoxypropyl, or chloropropyl. Alternatively, they may be made to react with an overlying layer (by using, for example, vinyl substitution where R is —CH=CH$_2$). Furthermore, these materials tend to degrade to $SiO_{2-x}$ glasses rather than low molecular-weight siloxanes. The simplest useful member of this family is polymethylsilsesquioxane, but higher-order T-resins and ladder polymers can be used to advantage.

Imaging layer 104 can consist of a polymeric system that intrinsically absorbs in the near-IR region, or a polymeric coating into which near-IR-absorbing components have been dispersed or dissolved. The following examples describe application of useful pigment-loaded nitrocellulose imaging layers onto a polyester substrate:

EXAMPLES 1–5

| Component | Parts |
|---|---|
| Nitrocellulose | 14 |
| Cymel 303 | 2 |
| 2-Butanone (methyl ethyl ketone) | 236 |

The nitrocellulose utilized is the 30% isopropanol wet 5–6 Sec RS Nitrocellulose supplied by Aqualon Co., Wilmington, Del. Cymel 303 is hexamethoxymethylmelamine, supplied by American Cyanamid Corp.

An IR-absorbing compound is added to this base composition and dispersed therein. Use of the following five compounds in the proportions that follow results in production of useful absorbing layers:

| Component | Parts | | | | |
|---|---|---|---|---|---|
| Example | 1 | 2 | 3 | 4 | 5 |
| Base Composition | 252 | 252 | 252 | 252 | 252 |
| NaCure 2530 | 4 | 4 | 4 | 4 | 4 |
| Vulcan XC-72 | 4 | — | — | — | — |
| Nigrosine Base NG-1 | — | 8 | — | — | — |
| Projet 900NP | — | — | 4 | — | — |
| Vanadium Oxide | — | — | — | 10 | — |
| Titanium Black 12-S | — | — | — | — | 8 |

NaCure 2530, supplied by King Industries, Norwalk, Conn., is an amine-blocked p-toluenesulfonic acid solution in an isopropanol/methanol blend. Vulcan XC-72 is a conductive carbon black pigment supplied by the Special Blacks Division of Cabot Corp., Waltham, Mass. Nigrosine Base NG-1 is supplied as a powder by N H Laboratories, Inc., Harrisburg, Pa. The vanadium oxide ($V_6O_{13}$) used above is supplied as a powder by Cerac Inc., Milwaukee, Wis. Titanium Black 12-S is available from Plastics & Chemical, Inc., Bernardsville, N.J.

Following addition of the IR absorber and dispersion thereof in the base composition, the blocked PTSA catalyst is added, and the resulting mixtures applied to the polyester substrate using a wire-wound rod. After drying to remove the volatile solvent(s) and curing (1 min at 300° F. in a lab convection oven performed both functions), the coatings are deposited at 1 g/m$^2$.

The nitrocellulose thermoset mechanism performs two functions, namely, anchorage of the coating to the polyester substrate and enhanced solvent resistance (of particular concern in a pressroom environment).

A polyvinyl alcohol composition (e.g., 5 pbw Airvol 125 to 95 pbw water) is applied with a wire-wound rod to the coated substrate (which may also be provided with a primer). The applied coating is dried for 1 min at 300° F. in a lab convection oven to an application weight of 0.5 g/m$^2$. A silicone coating is then applied to the polyvinyl alcohol layer. The following represents one suitable coating:

| Component | Parts |
|---|---|
| PS-445 | 22.56 |
| PC-072 | .04 |
| VM&P Naphtha | 76.70 |
| Syl-Off 7367 | .70 |

These components are conventional, and are described in detail in the '737 patent.

In a second embodiment, layer 108 is omitted, and layer 104 provided with a hydrophilic pigment in addition to or in lieu of the IR-absorptive pigments listed above. Naturally, if the hydrophilic pigment is used alone, either it or the polymeric binder in which it is dispersed provides the necessary absorption of imaging radiation. In one preferred approach, the pigments are introduced directly into the base composition. The following formulations may be substituted for the base compositions set forth above, and illustrate incorporation of silica fillers:

EXAMPLES 6–7

| Component | Parts | |
|---|---|---|
| Example | 6 | 7 |
| Nitrocellulose | 14 | 14 |
| Cymel 303 | 2 | 2 |
| Imsil A108 | 10 | — |
| Aerosil 90 | — | 3 |
| 2-Butanone (methyl ethyl ketone) | 236 | 236 |

The Imsil A108 product is a natural crystalline silica supplied by Unimin Specialty Minerals, Inc., Elco, Ill.; and the Aerosil 90 is a synthetic amorphous silica available from Degussa Corp., Pigments Division, Ridgefield Park, N.J.

Hydrophilic pigments can also be used in other ablatable coating formulations, such as those based on polypyrrole, polyaniline, and polythiophenes, which may be polymerized in-situ within a resin binder; see published PCT Application Serial No. WO 97/900735. The published application describes preparation of conductive polymers in situ to avoid problems arising from the nature of such polymers. Hydrophilic pigments can be used in combination with these in-situ-formed conductive polymers to enhance the hydrophilic character of debris resulting from their ablation. These hydrophilic pigments can be added in a final step, following completion of polymerization, via dispersion; indeed, the pigments can themselves be formed in situ. Alternatively, the pigments can be added prior to polymerization, in which case they can provide surfaces (nuclei) upon which the conductive polymers form. Preferred hydrophilic pigments (generally silicas), particle sizes, and the choice of natural or synthetic materials are dictated by the application. For example, where the pigments are intended to serve as nucleation sites, synthetic materials may be preferred for their high surface areas. Natural pigments, on the other hand, may be preferred in applications where excessive viscosity is to be avoided.

Figure 2B:
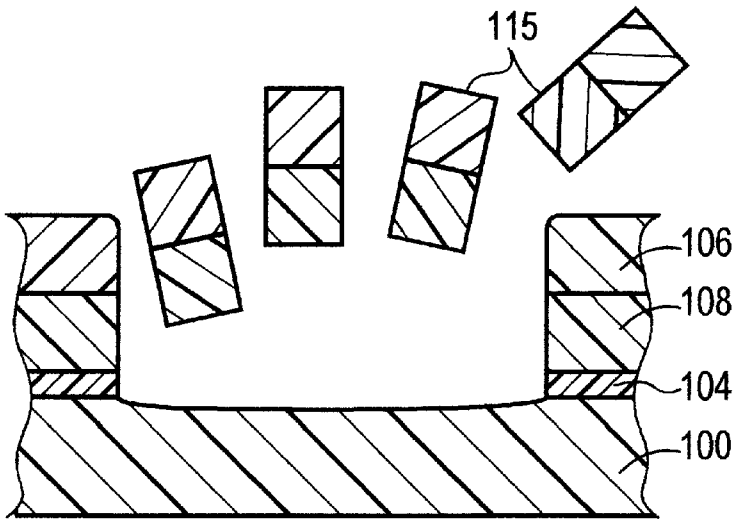
FIG. 2B illustrates the effect of cleaning the imaged plate with a water-based fluid.
Figure 2A:
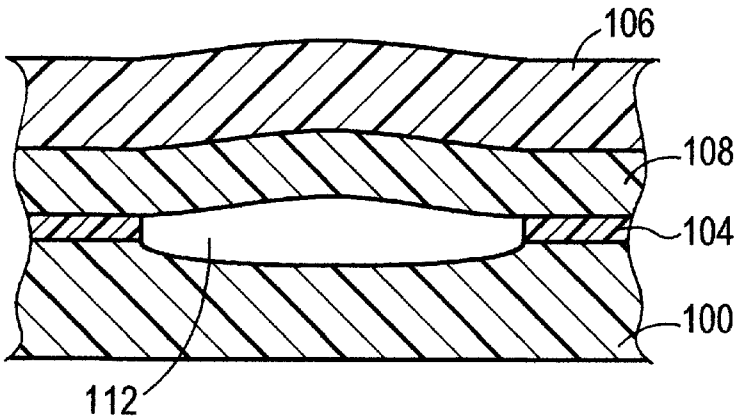
FIG. 2A illustrates the effect of imaging the plate shown in FIG. 1.

The effect of imaging a plate in accordance with FIG. 1 is shown in FIG. 2A. The imaging pulse ablates layer 104 in the region of exposure, leaving a deanchorage void 112 between layers 100, 108 that renders overlying layers 106, 108 amenable to removal by cleaning. That process, illustrated in FIG. 2B, is enhanced by the hydrophilicity of layer 108. With application of an aqueous cleaning fluid, the deanchored regions of layers 106, 108 break up into a series of fragments 115 that are drawn into the cleaning fluid and removed, leaving layer 100 exposed where the imaging pulse struck.

An exemplary aqueous cleaning fluid for use with printing members having a hydrophilic layer 108 is prepared by combining tap water (11.4 L), Simple Green concentrated cleaner, supplied by Sunshine Makers, Inc., Huntington Beach, Calif. (150 ml), and one capful of the Super Defoamer 225 product supplied by Varn Products Company, Oakland, N.J. This material may be applied to a rotating brush in contact with surface 106 following imaging, as described in U.S. Pat. No. 5,148,746, the entire disclosure of which is hereby incorporated by reference.

This type of modified imaging layer is not only useful in conjunction with an insulating layer 108, as illustrated, but also in a dry-plate construction lacking this layer—i.e., having an oleophilic substrate 100 and an oleophobic surface layer 106. In the latter case, the ability of the hydrophilic pigment to ease aqueous cleaning is valuable in its own right. It will therefore be seen that the foregoing techniques and constructions result in lithographic printing plates with superior printing and performance characteristics. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member having a printing surface and including (i) a first solid layer, (ii) an imaging layer comprising a polymeric matrix, (iii) a substrate underlying the imaging layer, and (iv) a material producing, in response to ablation of the imaging layer, debris having an affinity for an aqueous cleaning fluid that does not dissolve the first solid layer, the first layer and the substrate having different affinities for ink, the imaging layer, but not the first layer, comprising a material subject to ablative absorption of imaging radiation;

b. selectively exposing, in a pattern representing an image, the printing surface to imaging radiation so as to ablate the imaging layer; and c. removing, with the aqueous cleaning fluid, remaining portions of the first and imaging layers where the printing member received radiation.

2. The method of claim 1 wherein the debris-producing material is present as a solid insulating layer underlying the first layer, thermal degradation of the insulating layer producing the debris.

3. The method of claim 2 wherein the insulating layer of the printing member is a polyvinyl alcohol.

4. The method of claim 2 wherein the insulating layer of the printing member is hydroxycellulose.

5. The method of claim 2 wherein the insulating layer of the printing member is an acrylate material incorporating functional groups chemically compatible with the cleaning fluid.

6. The method of claim 2 wherein the insulating layer of the printing member is a T-resin.

7. The method of claim 2 wherein the insulating layer of the printing member is a ladder polymer.

8. The method of claim 2 wherein the insulating layer is hydrophilic.

9. The method of claim 1 wherein the debris-producing material is present in the imaging layer.

10. The method of claim 9 wherein the imaging layer comprises a hydrophilic pigment and means for absorbing imaging radiation.

11. The method of claim 10 wherein the means for absorbing imaging radiation is carbon black.

12. The method of claim 10 wherein the hydrophilic pigment is silica.

13. A lithographic printing member comprising:

a. a first solid layer;

b. a solid insulating layer underlying the first layer;

c. an imaging layer comprising a polymeric matrix;

d. a substrate underlying the imaging layer; and e. a material producing, in response to ablation of the imaging layer, debris having an affinity for an aqueous cleaning fluid that does not dissolve the first solid layer;

wherein f. the first layer and the substrate have different affinities for at least one printing liquid selected from the group consisting of ink and an abhesive fluid for ink; and g. the imaging layer, but not the first layer, comprises a material subject to ablative absorption of imaging radiation; and h. the solid insulating layer comprises the debris-producing material, thermal degradation of the insulating layer producing the debris.

14. The member of claim 13 wherein the insulating layer of the printing member is a polyvinyl alcohol.

15. The member of claim 13 wherein the insulating layer of the printing member is hydroxycellulose.

16. The member of claim 13 wherein the insulating layer of the printing member is an acrylate material incorporating functional groups chemically compatible with the cleaning fluid.

17. The member of claim 13 wherein the insulating layer of the printing member is a T-resin.

18. The member of claim 13 wherein the insulating layer of the printing member is a ladder polymer.

19. The member of claim 13 wherein the insulating layer is hydrophilic.

* * * * *